United States Patent [19]

Menaged

[11] Patent Number: 4,967,992

[45] Date of Patent: Nov. 6, 1990

[54] INFLATABLE READING STAND

[76] Inventor: David L. Menaged, 12260 S.W. 40th St., Miami, Fla. 33175

[21] Appl. No.: 475,947

[22] Filed: Feb. 6, 1990

[51] Int. Cl.[5] ..... A47G 1/24

[52] U.S. Cl. ..... 248/454; 248/441.1

[58] Field of Search ..... 248/454, 441.1, 460, 248/127, 446, 447, 176; 446/220; D21/59

[56] References Cited

U.S. PATENT DOCUMENTS

| | | | |
|---|---|---|---|
| 1,947,053 | 2/1934 | Mason | 248/454 |
| 4,508,307 | 4/1985 | Morales | 248/454 X |
| 4,758,216 | 10/1988 | Stupakis | 248/157 X |

*Primary Examiner*—Ramon O. Ramirez

*Attorney, Agent, or Firm*—Malloy, Downey & Malloy

[57] ABSTRACT

The present invention relates to an inflatable reading stand comprising an inflatable main body attached in air tight relation to an elongated base portion having a support edge, the main body including an exposed surface structured to support a book or other reading material thereon, the elongated base having a hand pump and hose assembly attached thereto to permit inflation and deflation of the main body whereby the angle of the exposed surface can be adjusted relative to the horizontal plane thereby allowing the user to view any reading material placed thereon while sitting in a comfortable, upright sitting position.

13 Claims, 1 Drawing Sheet

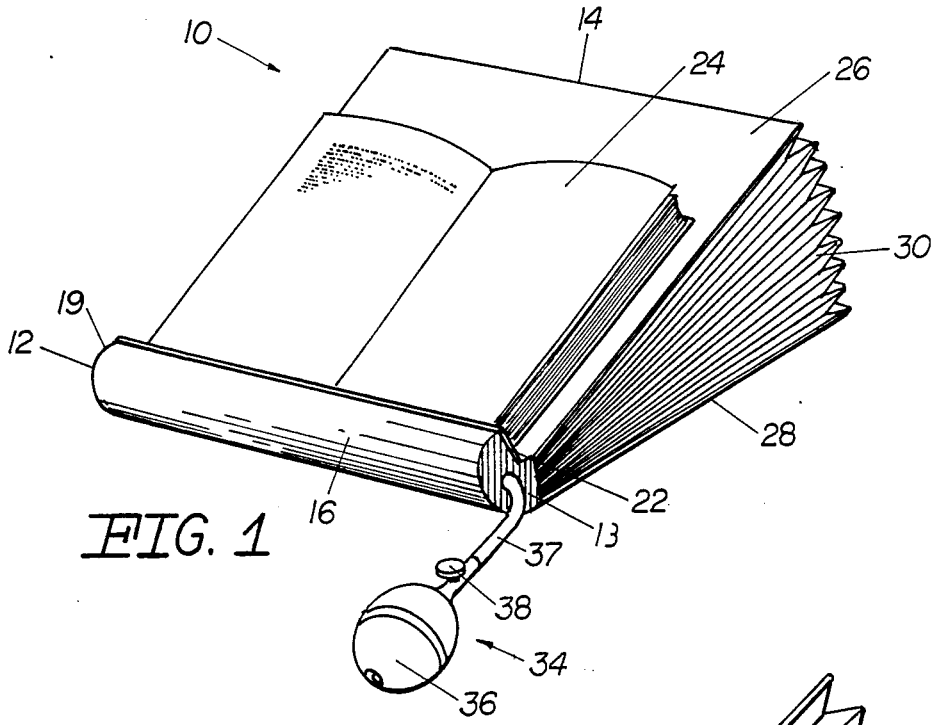
FIG. 1
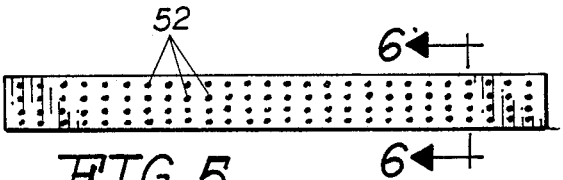
FIG. 5
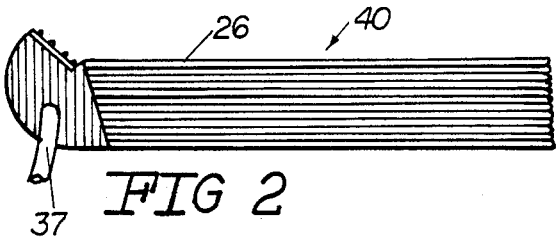
FIG 2
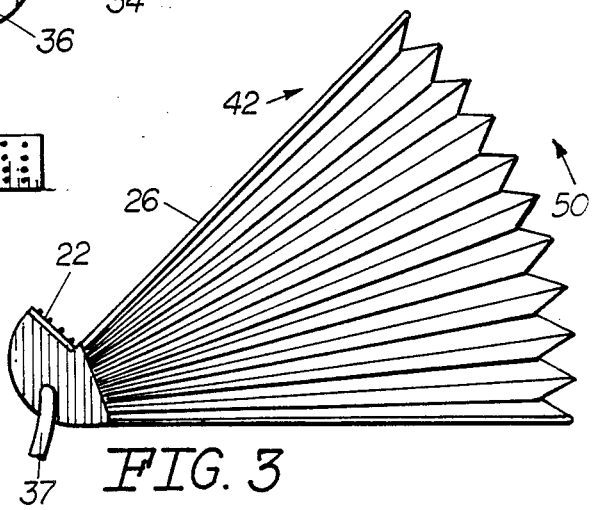
FIG. 3
FIG. 6
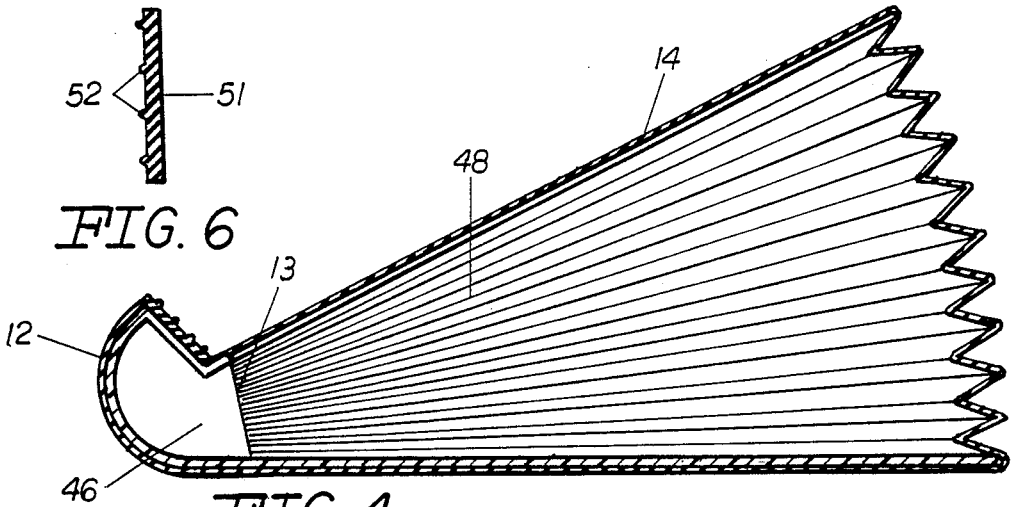
FIG. 4

INFLATABLE READING STAND

BACKGROUND OF THE INVENTION

1. Field of the Invention

An inflatable reading stand for use in supporting books or other such reading material wherein the reading stand is selectively adjustable at a range of angles relative to the horizontal plane to facilitate maximum reading performance while sitting in an upright and comfortable position.

2. Description of the Prior Art

Reading stands and other like devices more generically referred to as copy holders are used for a variety of purposes, generally associated with the support and position of various types of reading materials, such as books and magazines, in a more efficient and exposed position relative to the user's line of sight when sitting in an upright position. There are numerous structures in the prior art of the type set forth above, most of which comprise a support surface for placement of a book or reading material thereon, wherein the support surface is adjustable at a variety of angles relative to the horizontal by use of some type of longitudinally adjustable support arms which are pivotally mounted to the exposed surface so as to swing out at an angled position holding the exposed surface at an angled position relative to the user. A book, magazine, or other such reading material placed thereon is normally retained on the exposed surface in a preferred orientation for viewing. Typically, all of the reading stands in the prior art have sharp edges and removable parts which can be dangerous if used by young children. Furthermore, the reading stands of the prior art are basically uninteresting to operate and, therefore, do not add any creative interest in reading other than retaining the reading material in a preferred viewing orientation.

In view of the prior art, there still exists a need in the reading stand industry for a safer, more creative reading stand design which will stimulate an interest in young children and, therefore, make reading a more fun and enjoyable experience.

SUMMARY OF THE INVENTION

The present invention relates to an inflatable reading stand which is structured to support a book or other material thereon wherein the viewing angle can be adjusted by inflating and deflating the reading stand.

The inflatable reading stand of the present invention includes an elongated base including a support edge formed on an upper side thereof and structured to support the lower edge of a book resting thereon. The elongated base includes an open side extending along its length exposing a hollow interior of the base. The main body is attached around the peripheral edges of the open side of the base, the main body including an air chamber which is in air transferring relation to the hollow interior of the base. The main body includes a support surface formed of a substantially rigid, rubber-like material which is capable of supporting the weight of a book or other material placed thereon. A mounting face is formed on the main body in opposing relation to the support surface, the mounting face being generally adapted to rest on a flat, horizontal surface such as a tabletop or wherever the reading stand is placed during use. Extending between and connecting the support surface to the mounting face are three vertically expanding walls generally having an accordian-like configuration and adapted to expand and collapse during inflation and deflation of the reading stand. The vertically expanding walls are specifically structured so as to expand at progressively greater proportions moving from the elongated base towards the back side of the reading stand, such that the support surface rises at an increasing angle relative to the horizontal plane during inflation of the main body.

A hand pump and hose assembly are connected to the base, whereupon squeezing the hand pump acts to supply air into the hollow interior of the base and accordingly into the air chamber in the main body. As air is pumped into the air chamber, the main body expands causing the support surface to move upwardly with an increasing vertical angle. A valve is fitted to the air hose connecting between the base and hand pump, the valve being structured to operate between an opened and closed position In the open position, air is permitted to pass through the hose and into the air chamber as the hand pump is squeezed. With the valve left in the open position, once the user stops squeezing the hand pump, the air within the chamber of the main body flows outwardly through the hose and out of the valve causing deflation of the main body. To lock the reading stand in a partially inflated or fully inflated position, the valve is closed which prevents air from escaping from within the air chamber.

The support edge is generally formed of a substantially rigid rubber-like material and includes a plurality of nipple-like projections arranged in a series of linear rows extending along the length of the support edge. The projections on the support edge are specifically structured to maintain the pages of the reading material supported on the reading stand in place while the reader is reading a particular page.

It should be noted that the reading stand of the present invention is specifically structured for use by young children and, as such, is structured so as to have no sharp edges or removable parts which would be harmful if used by a young child.

BRIEF DESCRIPTION OF THE DRAWINGS

For a fuller understanding of the present invention, reference should be had to the following detailed description taken in connection with the accompanying drawings, in which:

FIG. 1 is a perspective view of a preferred embodiment of the present invention shown in use in combination with a book supported thereon.

FIG. 2 is a side view of the preferred embodiment of the present invention shown in a collapsed position.

FIG. 3 is a side view of the preferred embodiment of the present invention shown in a fully expanded position.

FIG. 4 is a sectional view taken from a side illustrating the interior of the preferred embodiment of the present invention.

FIG. 5 is an isolated top view of the support edge which is formed along the top portion of the base in the preferred embodiment of the present invention.

FIG. 6 is a sectional view taken along line 6—6 of FIG. 5.

DETAILED DESCRIPTION OF THE PREFERRED EMBODIMENT

As shown in FIGS. 1–6, and particularly FIG. 1, the preferred embodiment of the present invention comprises an inflatable reading stand generally indicated as 10 including an elongated base 12 and an inflatable main body 14 fixedly attached thereto. The elongated base 12 includes a curved side wall 16 and two oppositely disposed end walls 18 and 19. Formed on an upper side of the elongated base is a support edge 22 which is specifically structured and angled to support the lower edge of a book 24 when placed on an exposed supporting surface 26 of the main body 14. The support surface 26 on the main body is generally formed of a substantially rigid rubber-like material which is strong enough to support the weight of a book 24 when resting thereon. The main body 14 further includes a mounting face 28 on an under side of the reading stand which is generally adapted to rest on a mounting surface such as a flat tabletop. An expandable wall structure 30 extends between and connects the support surface 26 to the mounting face 28 and is generally structured to expand upon inflation of the main body 14 in such a manner as to raise the support surface 26 in a substantially vertical direction while constantly increasing the angle with the horizontal plane.

An air supply assembly 34 is attached to the base and, in a preferred embodiment, includes a hand pump 36 and an air hose 37 extending between the hand pump 36 and base 16. In addition, a valve 38 is fitted to the air hose 37 at a point adjacent to the hand pump 36, the valve operating between an opened and closed position wherein the opened position allows inflation and deflation and the closed position permits the reading stand to be fixed at a particular inflated position.

In use, the inflatable reading stand of the present invention operates between a collapsed position 40, as shown in FIG. 2, and a fully expanded position 42 as shown in FIG. 3. In the fully expanded position 42, the support surface 26 forms a substantially perpendicular angle with the supporting edge 22, wherein the support surface 26 is at a maximum angle relative to the horizontal plane providing a preferred viewing orientation of reading material placed thereon.

With reference to FIG. 4, the main body 14 is connected to the elongated base 12 at an open end 13 of the elongated base wherein a hollow interior 46 in the base is in air transferring relation with a hollow air chamber 48 in the main body 14. By squeezing the bulbous structure 36 of the air supply assembly 34, air is forced through the air hose 37 and into the hollow interior 46 of the base where it thereafter enters into the air chamber 48 of the main body. As more air is pumped into the base 12, the vertically expanding wall structure 30 begins to expand at increasing proportions moving away from the base 12 causing the support surface 26 to rise in the direction of the arrow 50 as shown in FIG. 3.

In a preferred embodiment, the support edge 22 is formed of a substantially rigid, rubber-like material 51 and includes a plurality of raised nipple portions 52 arranged in a series of linear rows, as shown in FIGS. 5 and 6. These projections are specifically structured to hold the lower edge of pages of a book 24 or other reading material in place while a reader is reading a particular page.

Now that the invention has been described,

What is claimed is:

1. An inflatable book support assembly comprising:

(a) an elongated base having a hollow interior including an open side and at least one side wall extending between a first end wall and a second end wall, (b) a support edge formed in an upper portion of said base between and adjacent to said, side wall and said open side, said support edge being structured and configured to support a book's lower end thereon, (c) inflatable main body fixedly attached to said base about the periphery of said open side in air tight, sealing relation to said hollow interior, said main body including a hollow air chamber in air receiving relation to said hollow interior of said base, (d) a support surface on an upper portion of said main body having a substantially planar configuration and formed of a substantially rigid material adapted for supporting a book thereon, (e) a mounting face formed on a bottom portion of said main body in opposing relation to said support surface, said mounting face having a substantially planar configuration and structured to be mounted on a flat horizontal mounting surface, (f) expansion means on at least three vertically expanding walls of said main body, said expansion means structured and configured to allow said support surface to move between a collapsed position and a fully expanded position relative to said mounting face, and (g) air supply means attached to said support assembly for supplying air to said hollow air chamber whereby inflation and deflation of said main body causes said support surface to move between said collapsed position and said fully expanded position

2. An assembly as in claim 1 wherein said support edge is formed of a substantially rigid rubber material.

3. An assembly as in claim 2 wherein said support edge includes a plurality of raised projections in the form of semi-spherical bumps arranged in a plurality of linear rows and adapted for holding the lower edge of pages being supported on the assembly.

4. An assembly as in claim 3 wherein said base includes a flange extending outwardly room said open side in perpendicular relation to said support edge.

5. An assembly as in claim 1 wherein said support surface is formed of a substantially rigid rubber material adapted for supporting a book thereon.

6. An assembly as in claim 5 wherein said mounting surface is formed of a substantially rigid rubber material.

7. An assembly as in claim 1 wherein said expansion means includes an accordian-type configuration formed on said three vertically extending walls and structured to permit said support surface to move between said collapsed position and said fully expanded position.

8. An assembly as in claim 1 wherein said air supply means includes a hand pump and an air hose connecting between said hand pump and said base in air transferring relation to said hollow interior.

9. An assembly as in claim 8 wherein said hand pump is formed of a hollow bulbous structure having an intake valve and an outlet, the hand pump operable by squeezing the bulbous structure in a user's hand whereby air is drawn through said intake valve upon expansion of said bulbous structure and air is forced out of said outlet and into said air hose upon squeezing said bulbous structure.

10. An assembly as in claim 9 wherein said hand pump includes a valve fitted to said hose and structured to operate between an open and closed position, the open position defining an inflation/deflation position, and the closed position defining a locked position.

11. An assembly as in claim 1 wherein said support surface is substantially perpendicular to said support edge in the fully expanded position.

12. An assembly as in claim 1 wherein said vertically expanding walls include two oppositely disposed side expanding walls extending along a side of said main body between said base and a back expanding wall.

13. An assembly as in claim 12 wherein said side expanding walls are structured to expand at increasing proportions moving away from said base toward said back expanding wall.

* * * * *